United States Patent [19]

Lohrmann

[11] 4,375,082

[45] Feb. 22, 1983

[54] HIGH SPEED RECTANGLE FUNCTION GENERATOR

[75] Inventor: Dieter R. Lohrmann, Lanham, Md.

[73] Assignee: The United States of America as represented by the Secretary of the Army, Washington, D.C.

[21] Appl. No.: 216,232

[22] Filed: Dec. 15, 1980

[51] Int. Cl.[3] ..... G06G 7/26

[52] U.S. Cl. ..... 364/851; 307/490; 307/261; 307/265; 328/178

[58] Field of Search ..... 364/851, 852, 853, 854; 307/490, 260, 261, 265–267; 328/13, 14, 28, 30, 32, 59–61, 142, 178, 180, 186

[56] References Cited

U.S. PATENT DOCUMENTS 3,753,133 8/1973 Shumate, Jr. ..... 307/261 X 4,101,789 7/1978 Ruhnau ..... 307/261 X 4,117,757 10/1978 Akamatu ..... 307/261 X 4,176,286 11/1979 Shuffield, Jr. ..... 307/261 X 4,283,637 8/1981 Handte et al. ..... 307/261 X 4,307,305 12/1981 Morris ..... 307/261

*Primary Examiner*—Joseph F. Ruggiero

*Attorney, Agent, or Firm*—Saul Elbaum; Nathan Edelberg; Robert P. Gibson

[57] ABSTRACT

A high speed rectangle function generator which provides a rectangular output voltage in response to an input voltage. A voltage divider produces switching points in conjunction with an input voltage to switch inversion and non-inversion amplifiers. The outputs of the inversion and non-inversion amplifiers are summed to produce a rectangular output voltage. Operational amplifiers are utilized as inversion and non-inversion amplifiers.

12 Claims, 7 Drawing Figures

HIGH SPEED RECTANGLE FUNCTION GENERATOR

RIGHTS OF THE GOVERNMENT

The invention described herein may be manufactured, used or licensed by or for the government of the United States of America for governmental purposes without payment to me of any royalties therefor.

BACKGROUND OF THE INVENTION

This invention relates generally to rectangle function generators and more specifically to high speed rectangle function generators wherein the output response of the rectangle function generator to an input voltage level is in the order of nanoseconds. In particular, this invention relates to rectangle function generators which produce an output voltage $V_o$ which is a rectangle function, the argument of which is an input voltage, $V_{in}$, rather than time, t, i.e., $V_o$=rect ($V_{in}$) rather than $V_o$=-rect (t).

For many applications it is highly desirable, for the proper functioning of a circuit or a device, to be able to generate highly accurate high speed rectangular or square waves. Many circuits and devices are capable of generating rectangular waves, however, for high speed waves, i.e., waves with a period in the order of microseconds, it is necessary to have the circuit or device generate a rectangle function as close to instantaneously as possible and at least in the order of nanoseconds, in response to an input voltage. Such devices may be needed, for example, in the construction of specialized radar signal processors. Prior art devices, such as microcomputers or microprocessors, have been used to generate rectangular waves. However, the calculations required to produce an output, $V_o$, in a microcomputer or microprocessor in response to an input voltage, $V_{in}$, takes time to compute. This results in $V_o$ being delayed by this amount of time after $V_{in}$ is input to the computer.

It is therefore one object of this invention to provide a device that is capable of generating high speed rectangular waves as a function of an input voltage.

It is another object of this invention to provide a device that is capable of generating high speed rectangular waves that is simple and inexpensive.

It is a further object of this invention to provide a device that is capable of generating high speed rectangular waves with a period in the order of microseconds.

It is still a further object of this invention to provide a device that is capable of generating high speed rectangular waves with an output response to an input voltage in the order of nanoseconds.

Other objects, advantages and novel features of the present invention will become apparent from the following detailed description of the invention when considered in conjunction with the accompanying drawings.

SUMMARY OF THE INVENTION

These and other objects, features and advantages of the invention are accomplished by a device wherein a voltage divider provides a series of sequential switching points in response to a varying input voltage. These sequential switching points cause a series of inversion and non-inversion amplifiers to provide outputs which are summed into a single output.

BRIEF DESCRIPTION OF THE DRAWINGS

The above and further objects and novel features of the invention will more fully appear from the following description when the same is read in conjunction with the accompanying drawings. It is to be understood, however, that the drawings are for the purpose of illustration only, and are not intended as a definition of the limits of the invention.

DESCRIPTION OF THE PREFERRED EMBODIMENT

Figure 1:
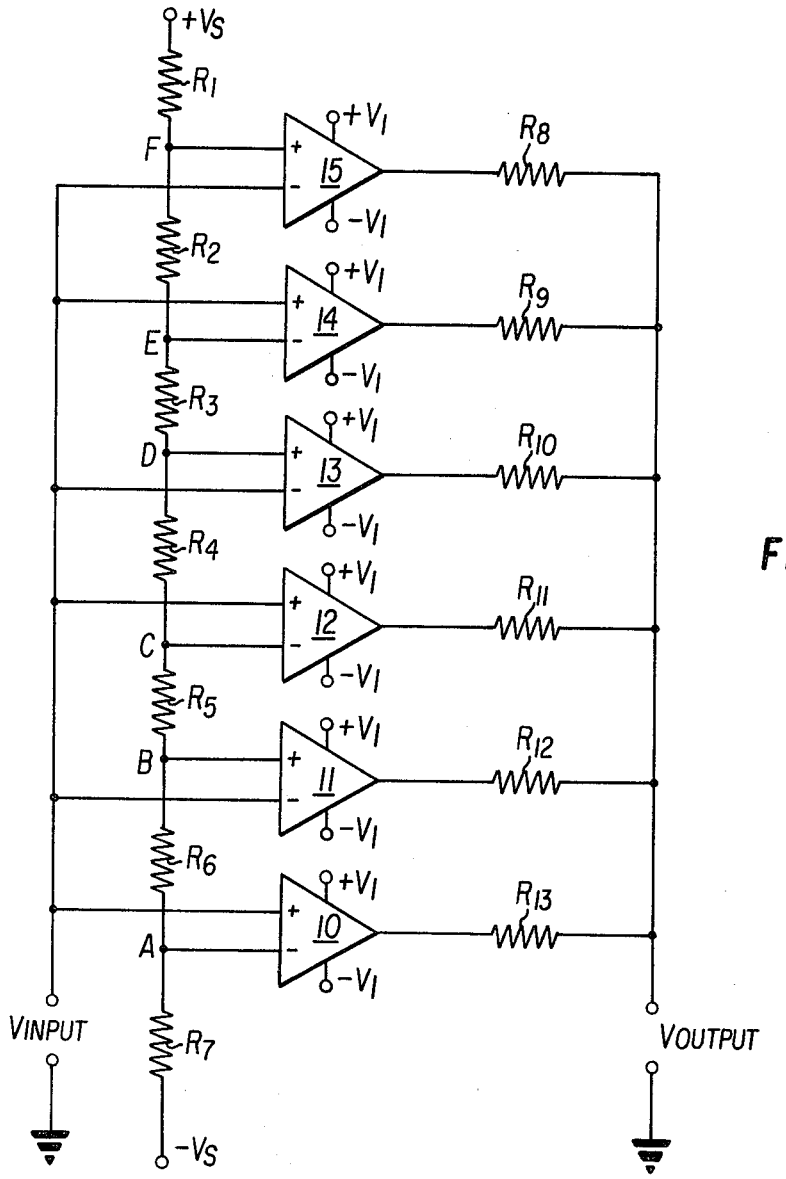
FIG. 1 illustrates schematically one embodiment of the present invention.

Referring now to the drawings, FIG. 1 is a schematic illustration of one embodiment of the present invention. Operational amplifiers 10–15 are connected to a voltage divider means made up of resistors $R_1$–$R_7$. An example of an operational amplifier that can be used is the $\mu$A715. The resistors $R_1$ through $R_7$ form a voltage divider and divide an impressed voltage represented by $+V_s$ and $-V_s$ between each successive resistor. For example, a voltage is provided at node F which is between the resistor pair made up of $R_1$ and $R_2$, a different voltage is provided at node E, which is between the resistor pair $R_2$ and $R_3$, etc. It can be appreciated by those of ordinary skill in the art that if resistors $R_2$ through $R_6$ are of equal value, the voltage differences between each node will be the same. Each successive node is connected to a successive operational amplifier and to an alternate input of each successive operational amplifier. For example, node F is connected to the positive input of operational amplifier 15, node E is connected to the negative input of operational amplifier 14, etc. It also can be appreciated by those of ordinary skill in the art that this method of connection causes the operational amplifiers to act as alternate inversion, non-inversion amplifiers. An input voltage $V_{in}$ is applied to the other alternate inputs of the operational amplifiers, i.e., $V_{in}$ is applied to the negative input of operational amplifier 15, to the positive input of operational amplifier 14, etc. The output of an operational amplifier depends upon how the amplifier is biased and the voltage relationship between the positive and negative inputs. With nodes A-F at fixed voltages determined by the voltage divider network made up of resistors $R_1$–$R_7$ and voltages $+V_s$ and $-V_s$, the instantaneous input voltage $V_{in}$ then determines the switching point of each operational amplifier. The resistors $R_8$–$R_{13}$ form an adding network which combines the individual outputs of the operational amplifiers 10–15 into a single output.

Figure 2:
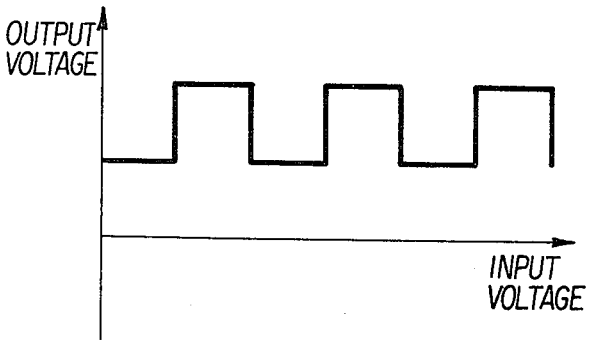
FIG. 2 graphically illustrates an input voltage and a uniformly spaced output voltage.

FIG. 2 illustrates graphically an output voltage with uniform spacing between the high outputs and the low outputs. It is noted that the low output may be zero volts. Uniform spacing is achieved by making resistors $R_2$–$R_6$ equal in value and making the input voltage $V_{in}$ linearly time variant.

Figure 3:
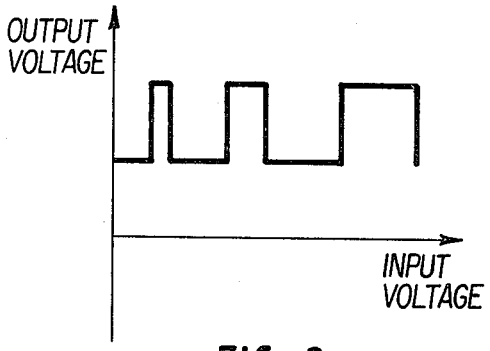
FIG. 3 graphically illustrating an input voltage and a non-uniformly spaced output voltage.

FIG. 3 illustrates graphically an output voltage with non-uniform spacing. This is achieved by varying the size of resistors $R_2$–$R_6$ so that the fixed voltages at nodes A–F vary non-uniformly.

Figure 5:
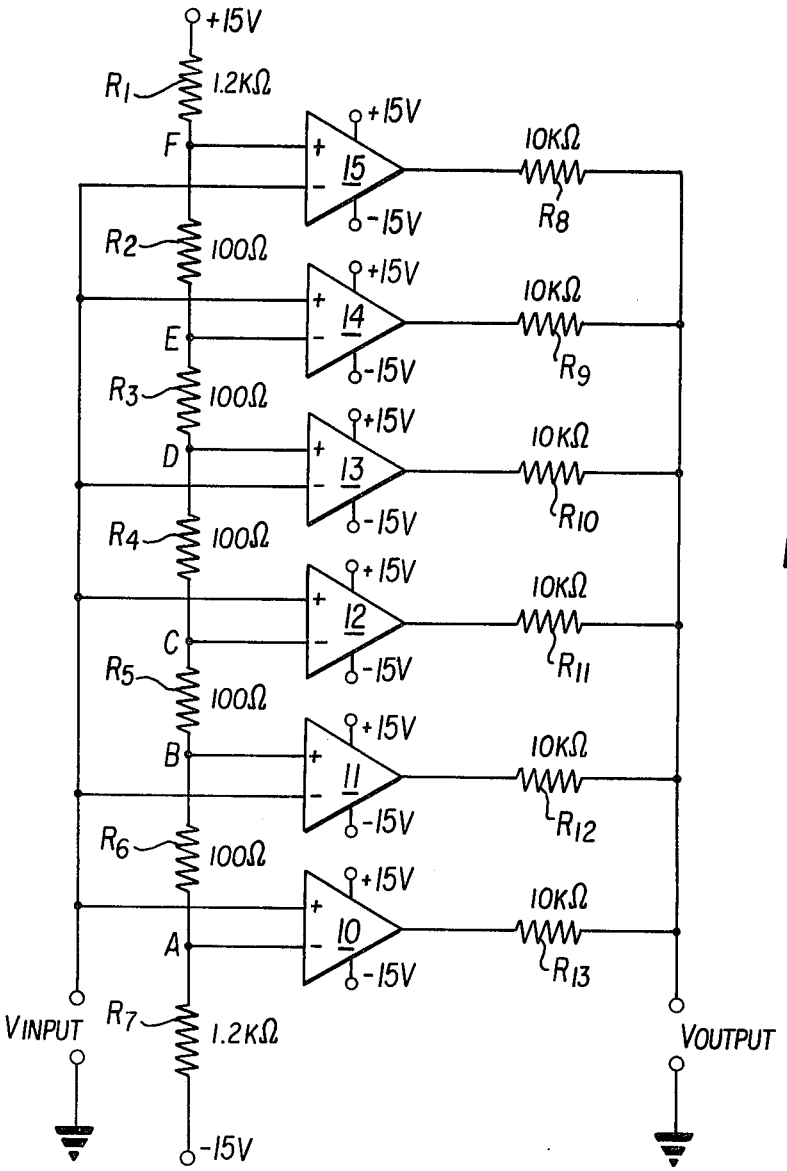
FIG. 5 illustrates schematically a specific embodiment of the present invention.
Figure 4:
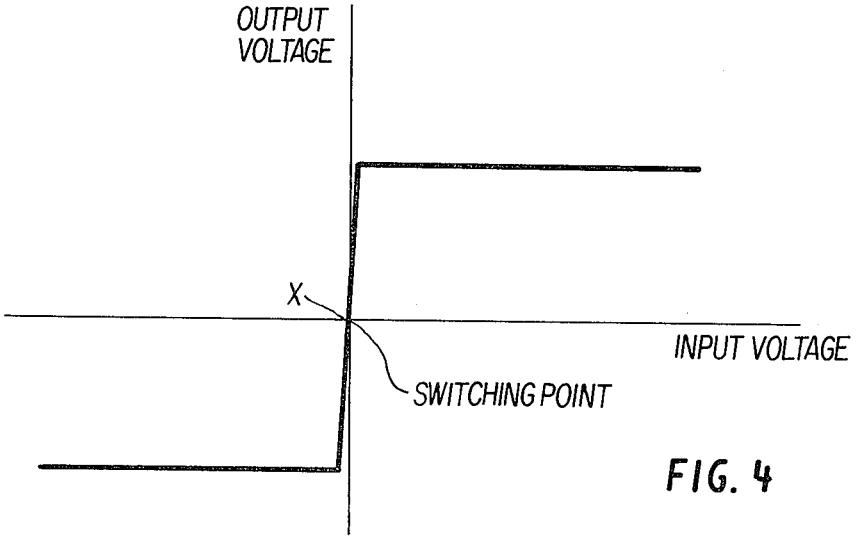
FIG. 4 illustrates graphically the characteristics of an operational amplifier.

FIG. 5 is a specific example of one embodiment of the present invention. This example is given for illustrative purposes only and is not to limit the scope of the present invention. The resistors $R_2$–$R_6$ are of equal value, the operational amplifiers are biased at plus and minus 15 volts, plus and minus 15 volts is applied across resistors $R_1$–$R_7$ and an input voltage $V_{in}$ is applied to the input. The operation of the high speed rectangle function generator will now be described: As long as the input voltage $V_{in}$ is below the fixed voltage at node A the outputs of operational amplifiers 10, 12 and 14 will be low, approximately −6 V, and the outputs of operational amplifiers 11, 13 and 15 will be high, approximately +6 V. As a result, the output behind the summing network, $R_8$–$R_{13}$ will be balanced to zero volts. When the input voltage $V_{in}$ is larger than the fixed voltage present at node A the output of operational amplifier is a +6 V rather than a −6 V. If the input voltage $V_{in}$ is also lower than the fixed voltage present at node B the outputs of operational amplifiers 10, 11, 13 and 15 are +6 V and the outputs of operational amplifiers 12 and 14 are −6 V. Therefore, there is an output of approximately +2 V behind the summing network. It is noted that the output of each operational amplifier will remain constant as long as $V_{in}$ is above the fixed voltage present at the appropriate node. This occurs because the operational amplifier goes into its saturation region as long as the relationship between $V_{in}$ and the node voltage is of the appropriate polarity, see FIG. 4, which is a graphical representation of the relationship between the output and input of a typical operational amplifier. For example, operational amplifier 10 switched from −6 V to +6 V when $V_{in}$ rose above the fixed voltage present at node A. Operational amplifier will then remain at +6 V as long as $V_{in}$ is above the fixed voltage at node A. When the input voltage $V_{in}$ rises above the fixed voltage present at node B operational amplifier 11 will switch from +6 V to −6 V. Therefore, as long as the input voltage $V_{in}$ is above the fixed voltage present at node B but less than the voltage at node C the outputs of operational amplifiers 11, 12, and 14 will be −6 V and the outputs of operational amplifiers 10, 13 and 15 will be +6 V thus causing the output behind the summing network to return to zero volts. This switching between zero volts and +2 V at the summing network output continues as $V_{in}$ reaches the appropriate voltage present at each node. With n operational amplifiers, there will be a maximum of n/2 cycles at the summing network output for a complete range of input voltage $V_{in}$. To obtain a continuous rectangular wave output, it can easily be seen by one of ordinary skill in the art that by returning $V_{in}$ to its original value all of the operational amplifiers are returned to their original state and the cycle described in the above analysis begins again.

Figure 6:
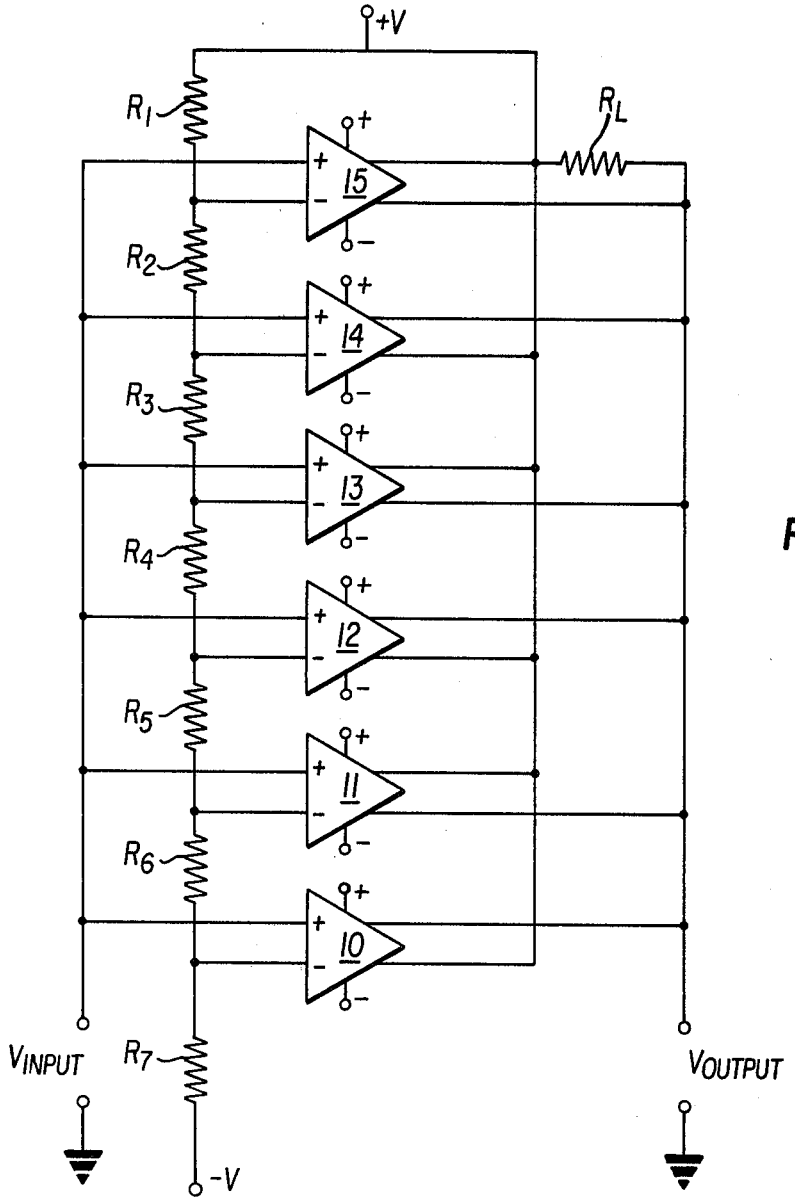
FIG. 6 illustrates schematically an alternate embodiment of the present invention.
Figure 7:
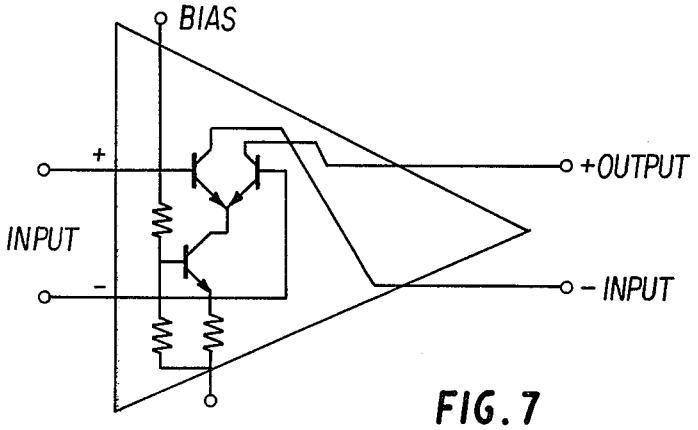
FIG. 7 illustrates schematically one embodiment of an operational amplifier.

From the analysis above, it can easily be seen how the equal spacing shown in FIG. 2 is achieved. By having resistors $R_2$–$R_6$ of equal value the fixed voltages at nodes A–F will differ by an equal amount. Then causing the input voltage $V_{in}$ to increase linearly, $V_{in}$ will reach the voltage at each node at equal intervals causing the spacing between the output pulses to be uniform. Similarly, by having the values of resistors $R_2$–$R_6$ differ, the fixed voltages at nodes A–F differ by an unequal amount. Thus, the application of an input voltage $V_{in}$ that increases linearly, $V_{in}$ will reach the fixed voltage present at each node at different intervals thus causing the spacing between each output pulse to be non-uniform An alternate embodiment of the present invention is illustrated graphically in FIG. 6. In this embodiment, the inversion is achieved at the amplifier outputs, i.e., the positive outputs of amplifier 10, 12 and 14 and the negative outputs of amplifiers 11, 13 and 15 are combined at the common load $R_L$ which also provides the output. An embodiment of a single operational amplifier shown at 10–15, FIG. 6 is shown in FIG. 7. It is noted that instead of bipolar transistors, FET's, tubes or any other similar elements could be used.

While I have described and illustrated several specific embodiments of the present invention, it will be clear that variations of the method and apparatus which are specifically illustrated and described may be resorted to without departing from the true spirit and scope of the invention as defined in the appended claims.

What I claim is:

1. A high speed rectangle function generator for generating an output voltage which is a rectangle function of a varying input voltage, comprising:

a plurality of amplifiers for generating amplifier output voltages which are switched between two voltage levels in accordance with the varying input voltage and respective fixed voltages, each amplifier output voltage being switched at high speed to one voltage level whenever the input voltage rises above the fixed voltage and being switched at high speed to the other voltage level whenever the input voltage falls below the fixed voltage;

fixed voltage generating means for generating said fixed voltages which are supplied respectively to said amplifiers; and summing means for summing the amplifier output voltages to generate the output voltage of the rectangle function generator;

wherein the amplifiers are connected to receive the input voltage and the respective fixed voltages and to supply the amplifier output voltages to the summing means as alternately arranged inversion and non-inversion amplifiers so that, in each pair of amplifiers receiving adjacent fixed voltages, one amplifier is connected as an inversion amplifier and the other amplifier is connected as a non-inversion amplifier.

2. A high speed rectangle function generator as recited in claim 1, wherein said inversion and non-inversion amplifiers each comprise an operational amplifier.

3. A high speed rectangle function generator, as described in claim 1, wherein said plurality of amplifiers comprises at least three amplifiers.

4. A high speed rectangle function generator, as described in claim 1, wherein, in each pair of amplifiers receiving adjacent fixed voltages one amplifier has a positive input connected to receive the input voltage, a negative input connected to receive one fixed voltage and an output connected to the summing means; and the other amplifier has a positive input connected to receive the other fixed voltage, an negative input connected to receive the input voltage, and an output connected to the summing means.

5. A high speed rectangle function generator, as described in claim 4, wherein the summing means comprises a like plurality of resistors having first ends connected respectively to the amplifier outputs and second ends connected to a common output of the rectangle function generator.

6. A high speed rectangle function generator, as described in claim 5, wherein the summing means resistors have equal resistance values.

7. A high speed rectangle function generator, as described in claim 5 or 6, wherein the plurality of amplifiers includes at least three amplifiers, and the fixed voltages are spaced at equal voltage increments from the lowest fixed voltage to the highest fixed voltage.

8. A high speed rectangle function generator, as described in claim 1, wherein:

the scanning means includes a load resistor;

each amplifier includes a positive input and a negative input, a corresponding one of the two inputs of each amplifier being connected to receive the input voltage and the other amplifier inputs being connected to the fixed voltage generating means to respectively receive the fixed voltages; and each amplifier includes a positive output and a negative output, which are connected in alternating manner to opposite ends of the load resistor so that, in each pair of amplifiers receiving adjacent fixed voltages, the positive and negative outputs of one amplifier are connected to first and second ends of the load resistor, respectively, and the positive and negative outputs of the other amplifier are connected to the second and first ends of the load resistor, respectively.

9. A high speed rectangle function generator, as described in claim 5, 6 or 8, wherein said plurality of amplifiers includes at least three amplifiers, and the fixed voltages are spaced at equal voltage increments from the lowest fixed voltage.

10. A high speed rectangle function generator, as described in claim 1, wherein the fixed voltage generating means comprises:

a fixed direct voltage source; and a voltage divider including a plurality of resistors connected in series across the fixed direct voltage source, wherein each pair of amplifiers receiving adjacent fixed voltages are connected to opposite ends of one of the voltage divider resistors.

11. A high speed rectangle function generator, as described in claim 10, wherein said plurality of amplifiers includes at least three amplifiers, and wherein the voltage divider resistors connected between the amplifiers have equal resistance values.

12. A high speed rectangle function generator, as described in claim 10, wherein said plurality of amplifiers includes at least three amplifiers, and wherein the voltage divider resistors connected between the amplifiers have unequal resistance values.

* * * * *